United States Patent [19]

Preston

[11] 3,967,491

[45] July 6, 1976

[54] CIGARETTE TESTING APPARATUS WITH INCLINED SLIDABLE SEALING MEANS

[75] Inventor: Edward G. Preston, London, England

[73] Assignee: Molins Limited, United Kingdom

[22] Filed: Jan. 31, 1975

[21] Appl. No.: 546,071

[30] Foreign Application Priority Data

Jan. 31, 1974 United Kingdom ..... 4464/74

[52] U.S. Cl. ..... 73/41; 73/38

[51] Int. Cl.[2] ..... G01M 3/04; G01M 15/08

[58] Field of Search ..... 73/38, 41, 45, 45.1, 73/45.2

[56] References Cited

UNITED STATES PATENTS

| | | | |
|---|---|---|---|
| 3,395,570 | 8/1968 | Kochalski | 73/45.2 |
| 3,485,084 | 12/1969 | Doerman | 73/45.1 |
| 3,769,832 | 11/1973 | Baier | 73/41 |

*Primary Examiner*—Richard C. Queisser
*Assistant Examiner*—John S. Appleman
*Attorney, Agent, or Firm*—Craig & Antonelli

[57] ABSTRACT

A device for testing cigarette wrappers includes a stationary member past which cigarettes are carried by a conveyor, the stationary member defining a suction chamber for producing an air flow through the cigarette wrapper, the ends of the chamber being sealed by means of slidable members which move over the ends of the cigarette, preferably in a direction inclined to the axis of the cigarette.

5 Claims, 4 Drawing Figures

FIG.1.
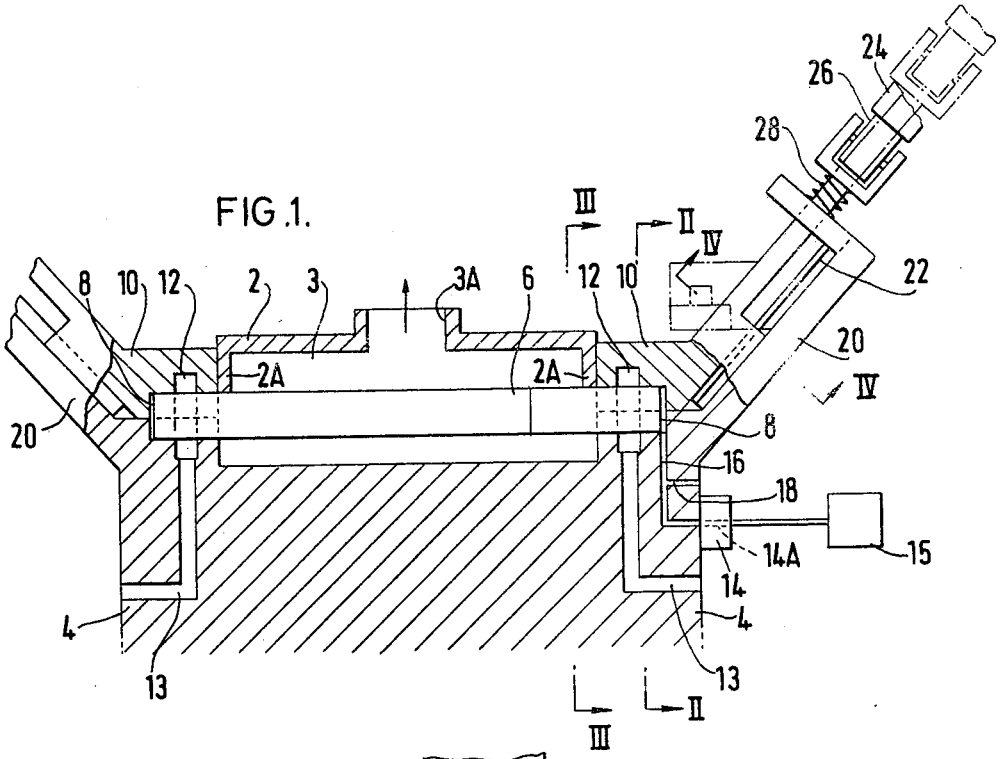
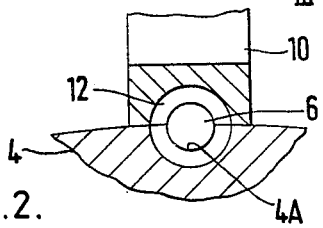
FIG.2.
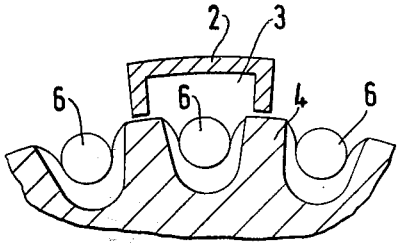
FIG.3.
FIG. 4.
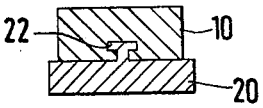

CIGARETTE TESTING APPARATUS WITH INCLINED SLIDABLE SEALING MEANS

This invention is concerned with testing the wrappers of cigarettes for leaks, especially in a manner which is basically as described in our British specification Nos. 1,195,682 and 1,195,683.

The above patent specifications describe a cigarette testing device including a fixed chamber past which cigarettes are moved on a drum (or other conveyor), the chamber having air at non-atmospheric pressure (preferably suction) to produce a difference in pressure between the outside and inside of each cigarette in turn at a testing station. The presence of an excessive leak through the wrapper is detected by monitoring the pressure in a space communicating with at least one end of the cigarette and consequently with the interior of the cigarette. Alternatively, the test could in principle be carried out by supplying air at non-atmospheric pressure into one or both ends of the cigarette, and monitoring the pressure in the chamber.

In the above specifications each end of the cigarette at the testing station is surrounded partly by a portion of the drum carrying the cigarette and partly by a pivoted cap. The present invention is concerned mainly with modifications in this area, that is to say in connection with the formation of seals around the ends of the cigarette.

A device according to the present invention, for testing the wrappers of cigarettes for leaks by producing a pressure differential between the inside and outside of each cigarette during testing, includes a conveyor for carrying the cigarettes during testing, a stationary member adjacent to the conveyor arranged to define, together with the conveyor, a chamber extending around each cigarette during testing, and movable sealing means carried by the conveyor adjacent to opposite ends of the cigarette for restricting communication between the chamber and the inside of the cigarette via the ends of the cigarette, the movable sealing means comprising slidable members which are slidably movable over the ends of the cigarette from positions spaced from the ends of the cigarette.

Each slidable member may be movable in a direction inclined to the axis of the cigarette. Alternatively it may move in a direction substantially parallel to the axis of the cigarette. However, the latter arrangement has the disadvantage that the leading end of the slidable member, as it approaches the end of the cigarette, may tend to catch on the end of the cigarette, though this tendency can be minimised by chamfering the inner edge of the leading end of the slidable member.

Alternatively the slidable member at each end of the cigarette may comprise an integral tubular member which is pushed over the end of the cigarette in the direction of the cigarette axis.

An example of a cigarette testing device according to this invention is shown in the accompanying drawings.

In these drawings:

FIG. 1 is a fragmentary sectional view of the testing device in a plane through the axis of rotation of the testing drum;

FIG. 2 is a fragmentary section on the line II—II in FIG. 1;

FIG. 3 is a fragmentary section on the line III—III in FIG. 1; and

FIG. 4 is a section on the line IV—IV in FIG. 1.

The testing device shown in the drawings has a stationary member 2 mounted adjacent to a testing drum 4 which is arranged to carrying cigarettes 6, during testing, past the member 2. The member 2 defines, together with the drum, a suction chamber 3, suction being supplied through a port 3A. Each end of the cigarette is surrounded during testing by a seal which restricts communication between the suction chamber 3 and an end space 8 communicating with the interior of the cigarette. The seal is formed at each end partly by a fluted portion 4A of the drum in which the cigarette rests, and partly by a slidably movable sealing member 10; only one sealing member 10 is shown complete in FIG. 1, the other sealing member being similar.

Each end of the suction chamber 3, as viewed in FIG. 1, is sealed by an abutting portion of the adjacent sealing member 10 which engages end wall 2A of the suction chamber.

The suction chamber 3 is shown in FIG. 3 to embrace only one cigarette at a time; i.e. the cigarette at the testing station. As an alternative, it could extend further around the drum 4 to embrace one or more cigarettes upstream of the testing station, so that suction begins to be applied to each cigarette well before it reaches the testing station.

Each seal comprises two parts which closely surround the cigarette (with slight clearance to avoid pinching the cigarette) and are separated by an annular groove 12 which is vented to atmosphere through a passage 13. Thus suction from the suction chamber 3 cannot be transmitted to the end space 8 through the seal.

At the testing station there is a fixed pad 14 which lies against the end face of the drum and has a passage 14A which communicates with the end space 8 via a passage 16 in the drum. The passage 14A in the pad 14 is connected to a pressure detector 15, for example in the form of a diaphragm transducer.

There is a predetermined leakage path to atmosphere from the space 8, this being provided partly by a passage 18 and partly by leakage from the end space 8 to atmosphere past the member 10. As an alternative, the leakage passage 18 could be omitted, and all the predetermined leakage could be provided by leaving an additional predetermined clearance between the end portion of the cigarette and the surrounding seal parts.

Each member 10 is linearly movable along a part 20 on the drum, which has a rail 22 for keeping the member 10 on the part 20 while allowing the necessary sliding motion. The chain-dotted outline shows the position to which the cap is moved before and after the testing station to enable the cigarette to be transferred to and from the drum by means of another fluted drum (not shown).

Movement of each sealing member 10 is controlled by a cam 24 extending about the axis of the drum 4. Each sealing member 10 carries a roller 26 serving as a cam follower, the roller 26 being urged against the cam by a spring 28.

The following modification is possible. The sealing members 10 could be arranged to move linearly substantially in the direction of the cigarette axis. In this case, the inner edge of the leading end of the sealing member, as it approaches the cigarette end, is preferably chamfered to facilitate movement of the sealing member over the cigarette end. Another possibility is that the sealing member may be resiliently mounted on a linearly movable device, being normally urged upwards so as to clear the cigarette end easily; then a cam or other device may be provided for pressing the sealing member downwards against the drum to complete the seal during testing.

According to another modification, the seal around each end of the cigarette may be provided by a tubular member which is pushed axially over the end of the cigarette prior to testing. In this case the tubular member again abuts one end wall 2A of the suction chamber 2 to complete the seal in that region and is preferably formed with an internal annular groove such as the groove 12 to ensure that the suction chamber is isolated from the space at the end of the cigarette. The inner edge of the inner end of the tube is preferably chamfered to provide a lead in as the tube passes over the end of the cigarette.

In FIG. 1 the position of one of the slidable members 10 when it is moved away from the cigarette is shown in chain-dotted outline. It will be noted that the member 10 moves along the part 20 of the drum through a distance sufficient to enable the cigarette to be transferred sideways to and from the drum.

I claim:

1. A device for testing the wrappers of cigarettes for leaks by producing a pressure differential between the inside and outside of each cigarette during testing, including a conveyor for carrying cigarettes during testing, a stationary member adjacent to the conveyor arranged to define, together with the conveyor, a chamber extending around each cigarette during testing, and movable sealing means carried by the conveyor adjacent to opposite ends of the cigarette for restricting communication between the chamber and the inside of the cigarette via the ends of the cigarette, the movable sealing means at least at one end of each cigarette comprising a slidable member which is slidably movable in a direction inclined to the axis of the cigarette over the end of the cigarette from a position spaced from the end of the cigarette so as to cooperate with part of the conveyor to surround the end of the cigarette, part of the seal being formed by the conveyor.

2. A device for testing the wrappers of cigarettes for leaks by producing a pressure differential between the inside and outside of each cigarette during testing, including a conveyor for carrying the cigarettes during testing, a stationary member adjacent to the conveyor arranged to define, together with the conveyor, a chamber extending around each cigarette during testing, and movable sealing means carried by the conveyor adjacent to opposite ends of the cigarette for restricting communication between the chamber and the inside of the cigarette via the ends of the cigarette, the movable sealing means comprising slidable members at each end of the cigarette which are slidably movable in a direction inclined to the axis of the cigarette over the ends of the cigarette from positions spaced from the ends of the cigarette so as to cooperate with part of the conveyor to surround the end of the cigarette, part of the seal being formed by the conveyor.

3. A device according to claim 2 in which the seal formed at each end of the cigarette by the conveyor and cooperating slidable member includes an annular space at atmospheric pressure to avoid any air flow between the chamber and the end of the cigarette.

4. A device according to claim 2 in which the chamber comprises a suction chamber, and including means for monitoring the pressure in a space adjacent to one end of the cigarette during testing, the magnitude of the suction pressure in that end space being indicative of the leakage flow through the cigarette wrapper.

5. A device according to claim 2 in which the conveyor is a fluted drum.

* * * * *